US005282498A

United States Patent [19]

Cahlander et al.

[11] Patent Number: 5,282,498

[45] Date of Patent: * Feb. 1, 1994

[54] PROD DISPENSER, DISPENSER CONTAINER AND METHOD

[75] Inventors: Robert L. Cahlander, Red Wing; David W. Carroll, Cannon Falls, both of Minn.; Alfred C. Hollingsworth, Naperville, Ill.; Gregory A. Lawrence, Red Wing; Brian R. Rudesill, St. Paul, both of Minn.

[73] Assignee: Restaurant Technology, Inc., Oak Brook, Ill.

[ * ] Notice: The portion of the term of this patent subsequent to Mar. 9, 2010 has been disclaimed.

[21] Appl. No.: 864,115

[22] Filed: Apr. 6, 1992

Related U.S. Application Data

[63] Continuation-in-part of Ser. No. 519,068, May 4, 1990, Pat. No. 5,191,918.

[51] Int. Cl.[5] ..... B65B 43/42; B67C 3/00

[52] U.S. Cl. ..... 141/129; 141/83; 141/168; 141/172; 141/275; 99/407; 177/114; 222/56

[58] Field of Search ..... 141/83, 129, 153, 172, 141/156, 157, 159, 161, 165, 168, 171, 176, 148, 253, 275; 99/407, 404; 426/108; 177/114; 222/56, 58, 77, 414; 221/158, 224, 225, 236; 53/475, 236

[56] References Cited

U.S. PATENT DOCUMENTS

| | | | |
|---|---|---|---|
| 1,630,676 | 5/1927 | Smith | 141/168 |
| 1,927,318 | 9/1933 | McEntee et al. | 141/165 |
| 2,466,386 | 4/1949 | Curioni | 198/52 |
| 2,475,523 | 7/1949 | Schroeder | 99/404 |
| 2,807,203 | 9/1957 | Buechele et al. | 99/404 |
| 3,080,999 | 3/1963 | Clarke et al. | 221/266 |
| 3,183,856 | 5/1965 | Jolly | 107/1 |
| 3,217,633 | 11/1965 | Anetsberger | 99/327 |
| 3,391,633 | 7/1968 | Boosalis | 99/357 |
| 3,408,920 | 11/1968 | Smith, Jr. | 99/236 |
| 3,442,423 | 5/1969 | Cozad | 222/70 |
| 3,448,677 | 6/1969 | Dexters | 99/336 |
| 3,474,891 | 10/1969 | Kamila | 198/33 |
| 3,505,072 | 4/1970 | Rullman | 99/1 |
| 3,645,196 | 2/1972 | Johnston et al. | 99/404 |
| 3,685,432 | 8/1972 | Hoeberigs | 99/357 |
| 3,690,247 | 9/1972 | Van Cleven et al. | 99/355 |
| 3,716,383 | 2/1973 | Yamamura | 99/353 |
| 3,908,531 | 9/1975 | Morley | 99/336 |
| 4,163,489 | 8/1979 | Wahl | 198/505 |
| 4,228,730 | 10/1980 | Schlinder et al. | 99/329 |
| 4,489,647 | 12/1984 | Stamps et al. | 99/336 |
| 4,685,386 | 8/1987 | Bezon | 99/404 |
| 4,687,119 | 8/1987 | Juillet | 221/101 |
| 4,719,849 | 1/1988 | Cope et al. | 99/404 |
| 4,809,881 | 3/1989 | Becker | 141/172 |

FOREIGN PATENT DOCUMENTS

| | | | |
|---|---|---|---|
| 35698A2 | 10/1989 | European Pat. Off. | 99/336 |
| 8020908 | 2/1982 | France | 99/336 |
| 0002954 | 1/1977 | Japan | 141/129 |
| 5078345 | 1/1977 | Japan | 141/129 |

*Primary Examiner*—Henry J. Recla
*Assistant Examiner*—Steven O. Douglas
*Attorney, Agent, or Firm*—Jenner & Block

[57] ABSTRACT

A portioning dispenser for bulk food items is disclosed which receives bulk food items in a storage bin, portions food items from the storage bin, and dispenses measured portions of food items for further processing. The dispenser can include a rotary drum for conveying food items from the storage bin and a load cell for weighing the quantity of items conveyed from the storage bin into a secondary bin. The dispenser can also include a conveyor system for sequentially accepting, filling and returning a plurality of portion containers. The dispenser can include one or more inclined ramps for allowing containers to be slidably conveyed within the dispenser to and away from a basket filling station. In another embodiment of the invention, a method is disclosed for dispensing measured portions of bulk food items which includes several of the above-discussed operations. A container especially suited for use in the dispenser is also disclosed.

40 Claims, 9 Drawing Sheets

10
30
32
68
E
F
82
G
H
64
70
72
66
74
54
M
D
C
B
12

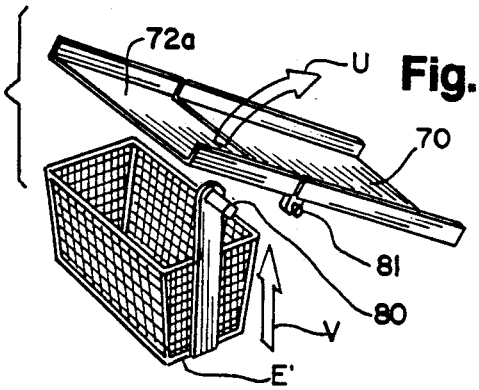
Fig. 7
Fig. 6
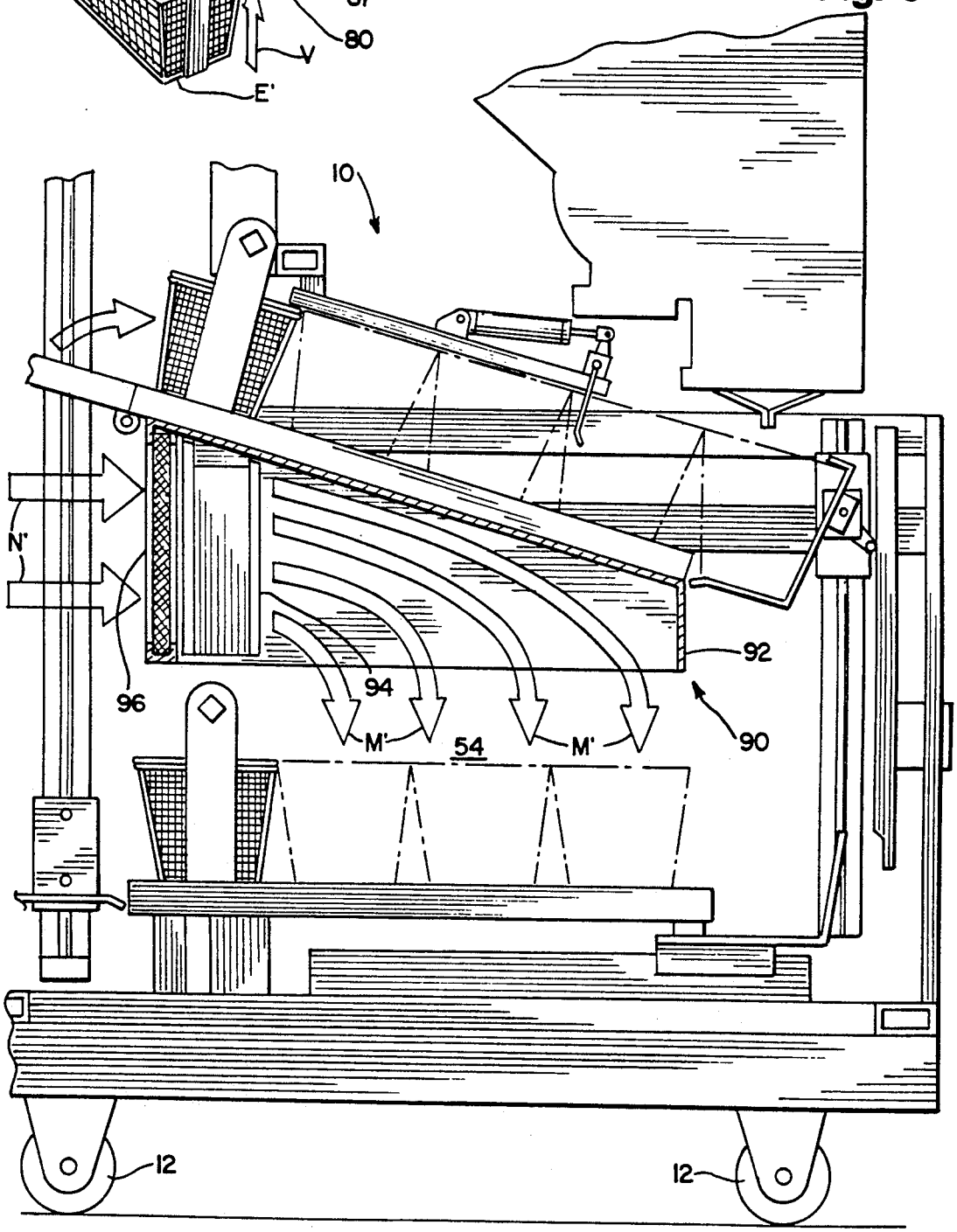

Fig. 8
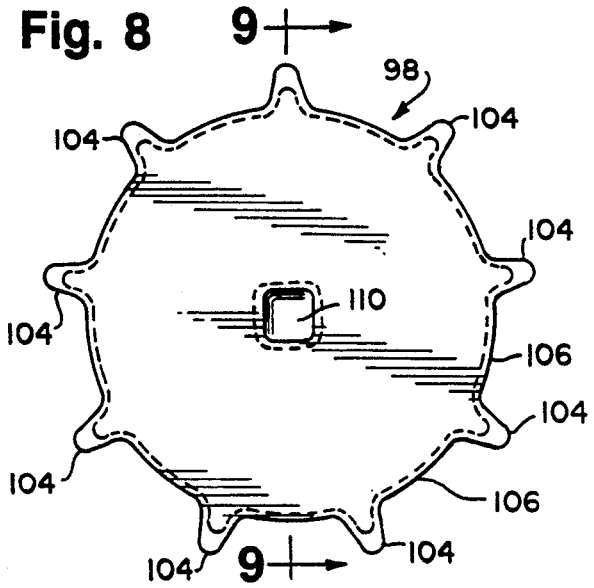
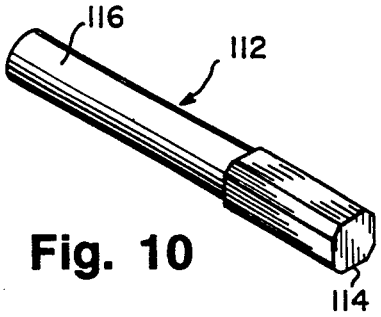
Fig. 10
Fig. 9
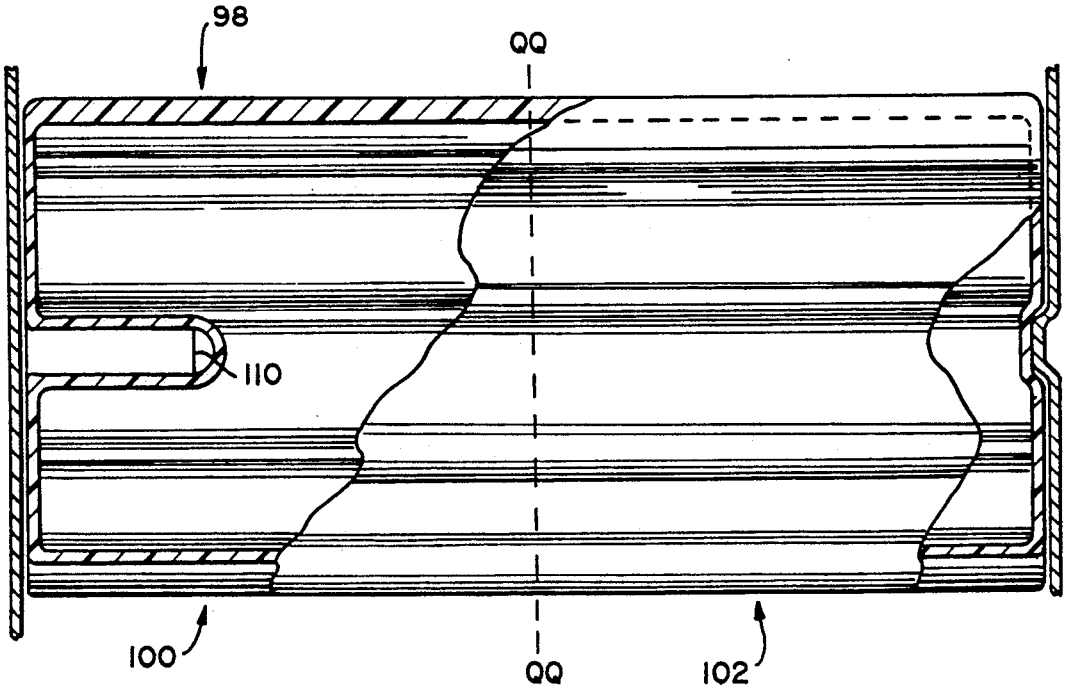

PROD DISPENSER, DISPENSER CONTAINER AND METHOD

RELATED APPLICATION

This application is a continuation-in-part application of U.S. application Ser. No. 07/519,068, filed May 4, 1990, now U.S. Pat. No. 5,191,918, issued Mar. 9, 1993, the disclosure of which is hereby incorporated by reference.

FIELD OF THE INVENTION

The invention relates to an apparatus and method for the automatic portioning and dispensing of bulk food items, especially for quick service restaurants. More particularly, the invention relates to an apparatus and method for automatically dispensing portions of food items from a reservoir designed to receive items from a bulk food item container.

BACKGROUND OF THE INVENTION

In restaurants, especially quick service (fast food) restaurants, fast, consistent, efficient and safe food preparation is essential for a successful operation. One important task frequently required in the preparation of fast food is the portioning of bulk food items supplied in bulk food containers.

Bulk food items are typically supplied in containers weighing several pounds to several tens of pounds. Each container holds a large number of individual food items such as french fries or chicken nuggets. The use of bulk containers is efficient because it minimizes the number of individual containers which must be transported to, handled, and stored at a restaurant. Because it is typically unnecessary, undesirable or impossible to prepare the entire contents of a given container at one time, the bulk food items must be portioned before cooking, heating or other processing can be performed.

Portioning of bulk food items involves many of the efficiency, speed, safety and consistency considerations involved in quick service food preparation generally. For example, consistent food preparation requires that portions be of a uniform size because over- or undersized portions may yield an under- or over-prepared food product when the portion is cooked, heated or otherwise processed. Additionally, portioning should be performed quickly to minimize food preparation delays to help insure prompt service. Furthermore, portioning operations should be non-labor intensive so as to efficiently utilize restaurant labor, particularly when such workers are in high demand and difficult to procure. Finally, portioning operations should minimize the manual manipulation of food products by restaurant workers, thereby minimizing safety concerns related to food handling generally.

Although quick service restaurants have existed for many years and now number in the tens of thousands, these establishments typically utilize labor intensive, manual processes to portion the contents of containerized bulk food products.

Accordingly, a need exists for a commercially suitable portioning apparatus for containerized bulk food items that minimizes manual food handling, requires little operator attention, and quickly, automatically and accurately portions bulk food items for serving, cooking or further preparation.

SUMMARY OF THE INVENTION

In accordance with the present invention, a portioning dispenser for bulk food items is disclosed that is especially adapted for a quick service restaurant. The dispenser is capable of receiving and storing bulk food items from a bulk food item container. The bulk food items can be any food product which requires proper portioning for preparation or serving. For example, the food product could be a meat, fish or poultry "nugget" product, or a vegetable product such as french fries. The food product could be cooked or uncooked, and could be in either a frozen or non-frozen condition.

More specifically, in one embodiment of the invention, structure is included for receiving and holding a quantity of bulk items, transferring at least some of the held items to a portion receiving device located at a container filling station, conveying a container to and from the filling station, and discharging items from the portion receiving device to the conveyed container at the container filling station. Additional features can include structure for measuring the quantity of items present in the portion receiving device, and for sequentially accepting empty containers and returning filled containers. The conveyance system can include two or more inclined ramps to permit slidable movement of the containers to and away from the filling station within the dispenser.

In yet another embodiment of the dispenser, a storage bin is provided for holding a quantity of food items in bulk such as, for example, french fries or chicken nuggets. A rotary drum is provided to dispense a portion of the storage bin contents into an optional secondary bin. The secondary bin includes a bin door for releasing the secondary bin contents when a measuring device indicates that a desired quantity of items has accumulated in the bin. A conveyance system having two or more inclined ramps is included to supply empty baskets to or return empty baskets from a container filling station. Additional features can include a pair of container elevators for vertically moving containers within the dispenser as well as one or more container stop mechanisms for inhibiting slidable movement of containers resting on the inclined ramps.

In still another embodiment of the dispenser invention, a reservoir is provided for holding a quantity of food items in bulk. A rotary drum conveys food items from the storage bin into a secondary bin. A measuring device measures the weight of the secondary bin contents and opens a bin door when a desired quantity of items is present in the bin, thereby discharging the items by gravity into a basket at a basket filling station. Baskets are moved to and from the basket filling station by a conveyor system having a pair of inclined ramps and a pair of elevators. The ramps allow baskets to slide towards and away from the filling station, and the basket elevators lower and raise filled baskets to and from a filling station and a basket input-output station.

A basket for use in the dispenser is also disclosed. The basket includes structure for receiving bulk items and structure for enhancing slidable movement on the dispenser's inclined container conveyance ramps. In some embodiments, one or more slides oriented parallel to the direction of container travel on the ramps enhance container travel on the ramps.

In yet another embodiment of the invention, a method is provided for dispensing bulk food items into containers for further processing. Bulk items are first emptied into a container reservoir and subsequently discharged into a bin. The bin is emptied when a desired portion of food items has been measured in the bin. Baskets are slidably conveyed on inclined ramps towards and away from a container filling station. Additional features can include lowering a filled basket to a second ramp and using an elevator to raise the basket from the second ramp.

In accordance with one aspect of the invention, a food dispenser is provided which can portion bulk food products for further processing.

In accordance with another aspect of the invention, a food dispenser is provided for portioning bulk food products which minimizes manual handling of food products which in turn minimizes safety and sanitation concerns related to the manual handling of food products.

In accordance with still another aspect of the invention, an automated portioning dispenser for bulk food products is provided which eliminates the need for manual portioning operations, thereby reducing labor costs and labor requirements.

BRIEF DESCRIPTION OF THE DRAWINGS

FIG. 6 is a side elevation view of one embodiment of the dispenser invention which incorporates an optional air thaw system; and FIG. 7 is a perspective view of another embodiment of the pivotable door ramp shown in FIG. 5.

FIG. 8 is a side elevation view of an alternative rotary drum construction useful in the invention;

FIG. 9 is a cross-sectional view of the drum of FIG. 8 taken along line 9—9 of FIG. 8;

FIG. 10 is a perspective view of a drive shaft useful in conjunction with the drum of FIGS. 8 and 9;

DETAILED DESCRIPTION OF THE INVENTION

One embodiment of a portioning dispenser for portioning bulk food items is shown in FIGS. 1-5. Throughout these FIGURES, like numbers refer to like parts. Although the illustrated embodiment is adapted to the portioning of french fries, the dispenser can portion other items such as meat, fish or poultry nuggets, and can dispense either fresh or frozen items in either a cooked or uncooked condition.

Figure 1:
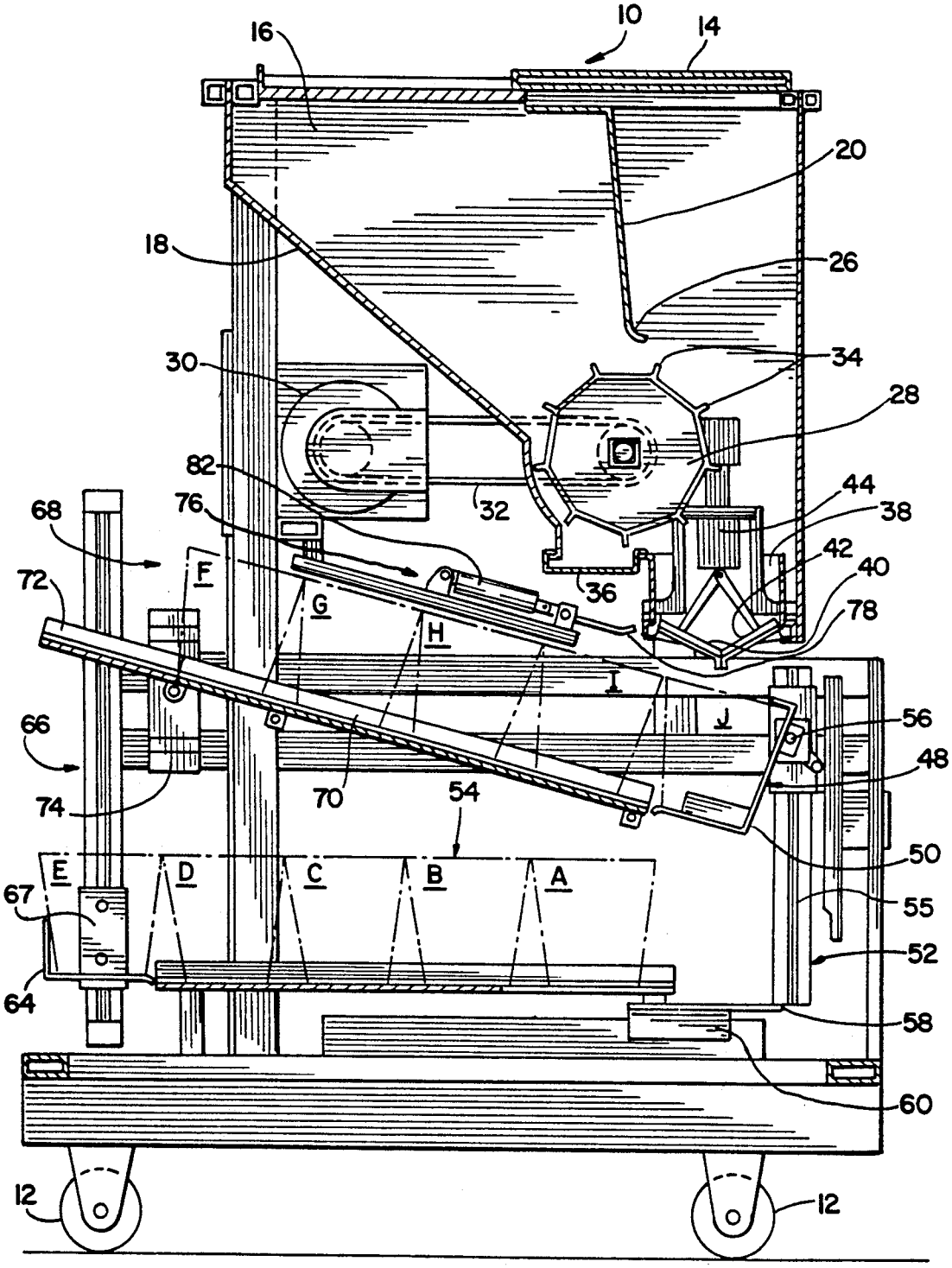
FIG. 1 is a front elevation view of one embodiment of the dispenser invention showing the internal structures of the invention.

FIG. 1 illustrates the general internal arrangement of components in a portioning dispenser 10 for bulk food items. The components of dispenser 10 are generally located within a cabinet 11 mounted on four wheels 12. Cabinet 11 includes a sliding door 14 which allows french fries to be dumped into a primary storage bin 16 from a bulk french fry container when door 14 is open.

Storage bin 16 includes an inclined reservoir wall 18 and a vertical reservoir wall 20 which, in conjunction with a pair of reservoir side walls 22 and 24 (see FIG. 2), channel bulk food items toward the bottom of storage bin 16.

Figure 2:
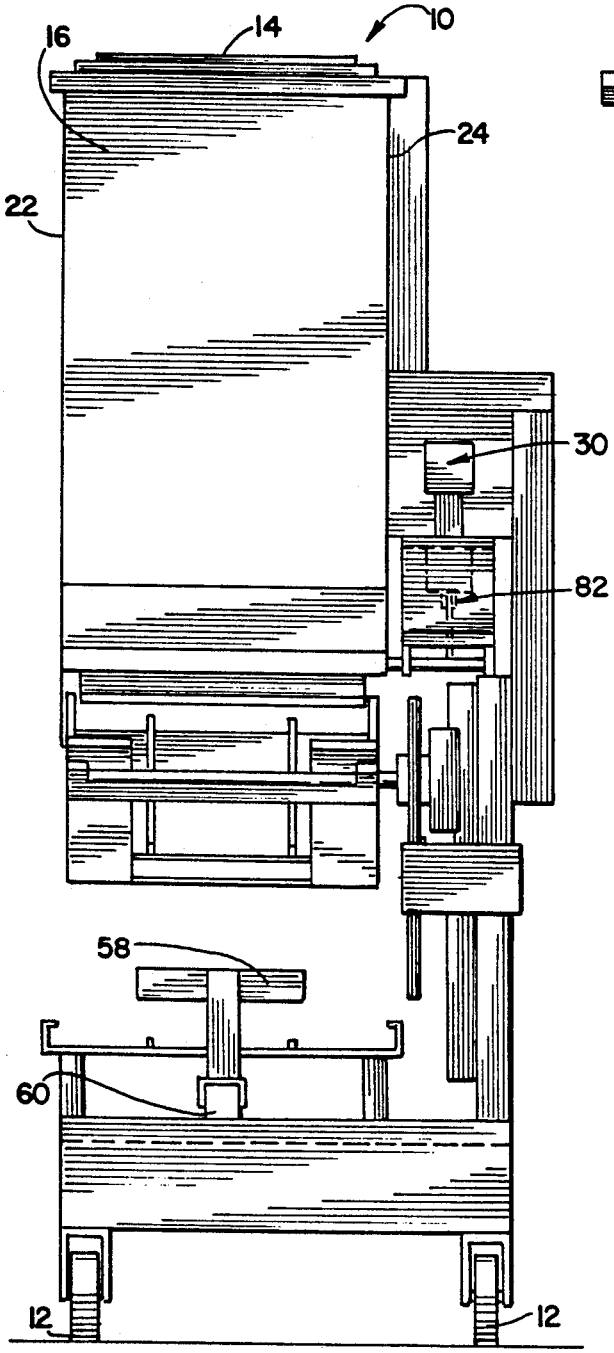
FIG. 2 is a simplified side elevation view of the embodiment illustrated in FIG. 1.
Figure 2A:
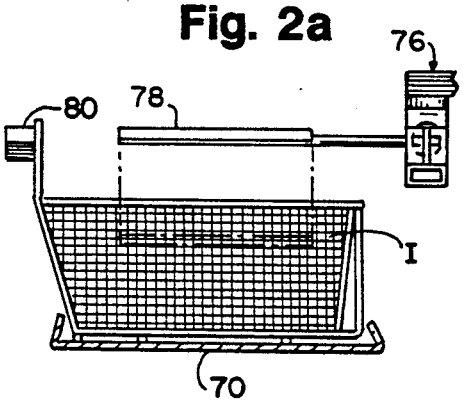
FIG. 2*a* is a side elevation view along lines 2*a*—2*a* of FIG. 4.
Figure 2B:
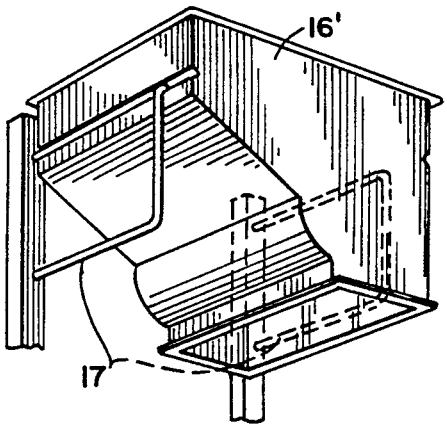
FIG. 2*b* is a perspective view of an alternate hopper embodiment useful in the dispenser of FIG. 1.

An alternate storage bin 16′ is illustrated in perspective view in FIG. 2*b*. Bin 16′ can be molded plastic and can be supported by support rods 17 located on each side of bin 16′. Support rods 17 allow bin 16′ to be removed by sliding bin 16′ horizontally out from rods 17.

French fries contained in storage bin 16 are conveyed by clockwise rotation of a rotary drum 28 located near the bottom of storage bin 16. Drum 28 is driven by an electric motor 30 and a drive belt 32 and includes a plurality of paddles 34. Paddles 34 convey fries from storage bin 16 past a fry deflector 26 when drum 28 rotates. As one alternative, grooves (not shown) could be provided on the surface of drum 28 in place of paddles 34. Deflector 26 operates in conjunction with paddles 34 and drum 28 to regulate and smooth the flow of fries from storage bin 16. Food items too small to be conveyed out of storage bin 16 by paddles 34 fall into a crumb tray 36 located at the bottom of storage bin 16. Tray 36 catches items such as crumbs and small pieces of broken french fries, thereby preventing these undesirable items from passing over drum 28 and into the dispensed french fry portions.

Fries pushed from storage bin 16 fall into a secondary bin 38 for weighing and dispensing. Secondary bin 38 includes a pair of downwardly opening doors 40 and 42 which open when a load cell 44 indicates that a desired weight of french fries has accumulated in secondary bin 38. Fries discharged from bin 38 fall into a fry basket J (shown in phantom) at a basket filling station 48. Secondary bin 38 and associated equipment for weighing is optional. Fries may be discharged directly into a basket at filling station 48 without secondary bin 38. At filling station 48, basket J sits on a basket frame 50. Frame 50 is part of a first elevator 52 used to lower filled baskets to a basket staging area 54. In the illustrated embodiment, elevator 52 employs a first elevator rodless cylinder 55 to provide vertical movement. Elevator 52 also includes a pivot mechanism 56 for pivoting frame 50 from an inclined orientation at filling station 48 to a horizontal orientation required to push basket 46 into staging area 54. Alternatively, pivot mechanism 56 could be omitted. In this case, basket J is simply pushed from an inclined frame into staging area 54, where the basket bottom comes to rest in a horizontal orientation.

Baskets lowered to staging area 54 are sequentially moved through area 54 by the action of a basket transfer arm 58. After elevator 52 has lowered basket frame 50 to staging area 54, horizontal basket transfer arm 58 pushes a filled basket from basket frame 50 into staging area 54. Transfer arm 58 is moved by actuating a horizontally moveable rodless staging cylinder 60 located below staging area 54. Any suitable motive means can be used to move transfer arm 58.

When staging area 54 is filled with full baskets, transfer arm 58 causes all baskets in staging area 54 to be pushed forward one basket position. This causes a basket E (shown in phantom in FIG. 1) to be pushed onto a basket frame lift 64 of a second elevator 66. A second elevator rodless cylinder 67 is then actuated to raise elevator 66 to a basket input-output station 68.

In addition to serving as a return point for filled baskets, basket input-output station 68 serves as a drop off point for empty fry baskets. An empty basket (not shown) placed on an inclined ramp 70 can slide towards basket filling station 48. Inclined ramp 70 includes a pivotable door 72 which can be moved by actuating a door cylinder 74 to allow filled baskets to pass by ramp 70 when raised on second elevator 66. Ramp 70 is inclined sufficiently so that baskets placed thereon will slide by gravity to basket filling station 48, unless restrained by basket stop arm 78, hereinafter described.

A basket stop mechanism 76 is mounted above ramp 70 for preventing empty baskets from sliding down ramp 70 at certain times in the filling cycle. Mechanism 76 includes a basket stop arm 78 which can be lowered into a basket (basket J in FIG. 3) to prevent movement of basket J and all baskets on ramp 70 above basket J. Stop arm 78 is lowered by actuating a basket stop air cylinder 82.

Various aspects of the location and shape of several of the above-discussed components are illustrated more clearly in FIG. 2. First, it should be noted that rotary drum motor 30 and basket stop cylinder 82 are mounted off to one side of cabinet 11. These mounting positions prevent contaminants or foreign objects, which might possibly otherwise fall from either device, from falling into baskets during the dispensing process. FIG. 2 also illustrates that basket transfer arm 58 engages a substantial portion of the top side of a fry basket, while FIG. 2*a* shows that transfer arm 58 engages a substantial length of a lower side of a fry basket F.

The operation of dispenser 10 now will be discussed in conjunction with FIGS. 3, 4 and 5. The following sequence of operations is intended only to be representative of the illustrated embodiment, and may be controlled by any type of controller known in the art. Unless otherwise specified, cylinders are two position pneumatic cylinders and cylinder actuation refers to moving a cylinder from one cylinder position to the other position.

Figure 3:
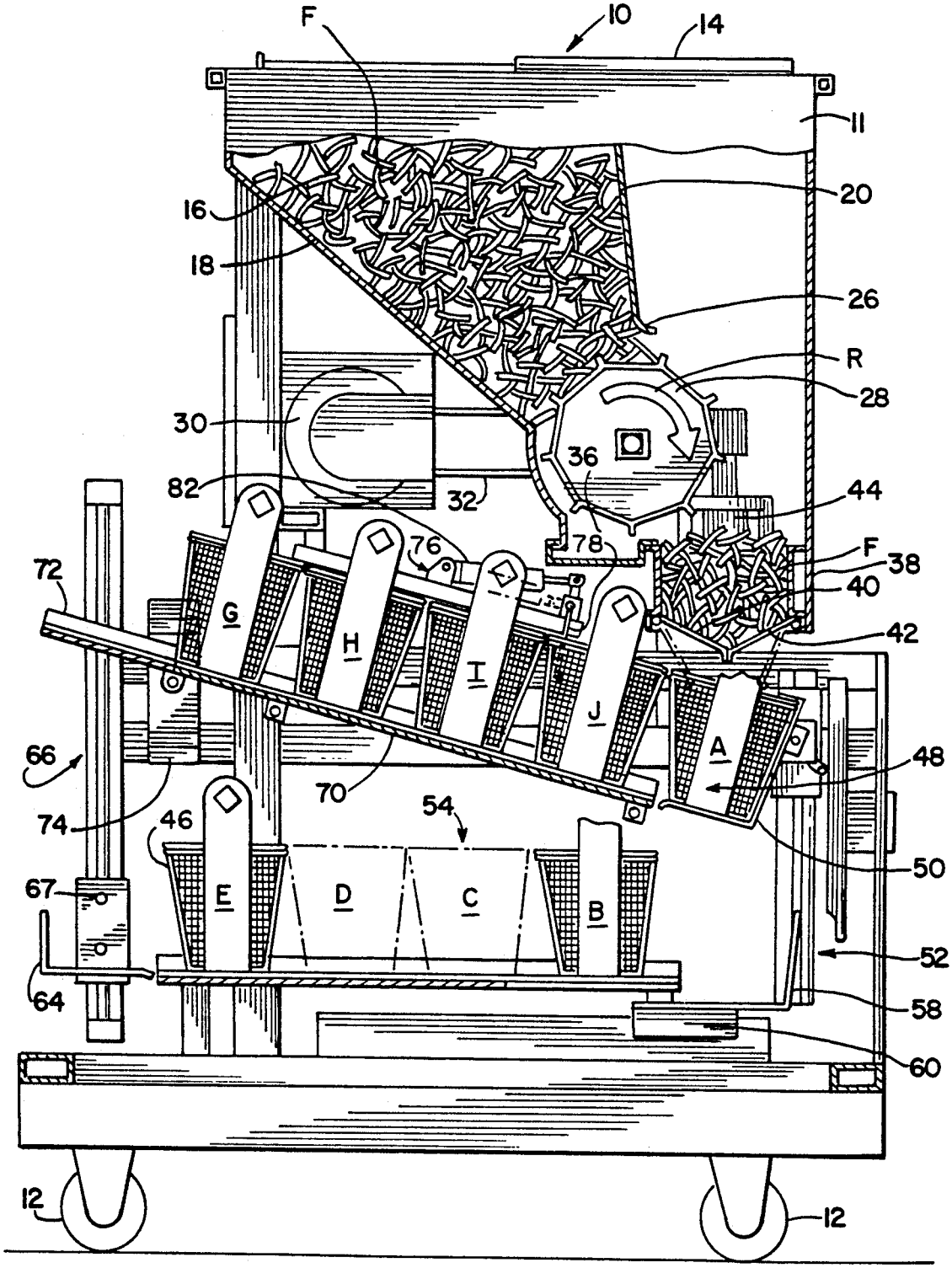
FIG. 3 is a side elevation view of the embodiment of FIG. 1 illustrating the basket filling operation.

Referring now to FIG. 3, dispenser 10 is made ready for operation by filling storage bin 16 with french fries F such as from a bulk french fry container or other source. The basket filling cycle begins when basket stop cylinder 82 is actuated, causing stop arm 78 to be raised from the lowered position shown in FIG. 3 to the position shown in FIG. 4. A reed switch (not shown) verifies that stop arm 78 is in the raised position, and an empty fry basket A slides down inclined ramp 70 onto basket frame 50. After basket A slides onto frame 50, stop cylinder 82 is actuated, and stop arm 78 returns to its original lowered position for retaining the empty baskets G, H, I and J on ramp 70 as shown in FIG. 3.

When basket A slides into frame 50, an elevator sensor (not shown) verifies that basket A is present, and rotary drum motor 30 is energized. Motor 30 causes rotary drum 28 to rotate in the direction of arrow R and convey french fries from storage bin 16 into secondary bin 38. After approximately 1.5 pounds of french fries have fallen into secondary bin 38, load cell 44 provides a signal which causes drum 28 to stop rotating and then activates a pair of secondary bin door air cylinders (not shown) to cause bin doors 40 and 42 to open downwardly, which allows the measured portion of fries F to fall into basket A. The bin door cylinders are then actuated again to close doors 40 and 42.

After basket A has been filled, first elevator 52 lowers basket A from filling station 48 to the level of staging area 54. Referring now to FIG. 4, pivot mechanism 56 turns lowered basket frame 50 from the inclined orientation required to accept empty basket A from ramp 70 to the horizontal orientation required to dispatch filled basket A into staging area 54. A reed switch (not shown) verifies the position and orientation of frame 50, and if frame 50 is in the proper location, staging cylinder 60 is actuated, causing basket transfer arm 58 to push basket A into staging area 54.

Figure 4:
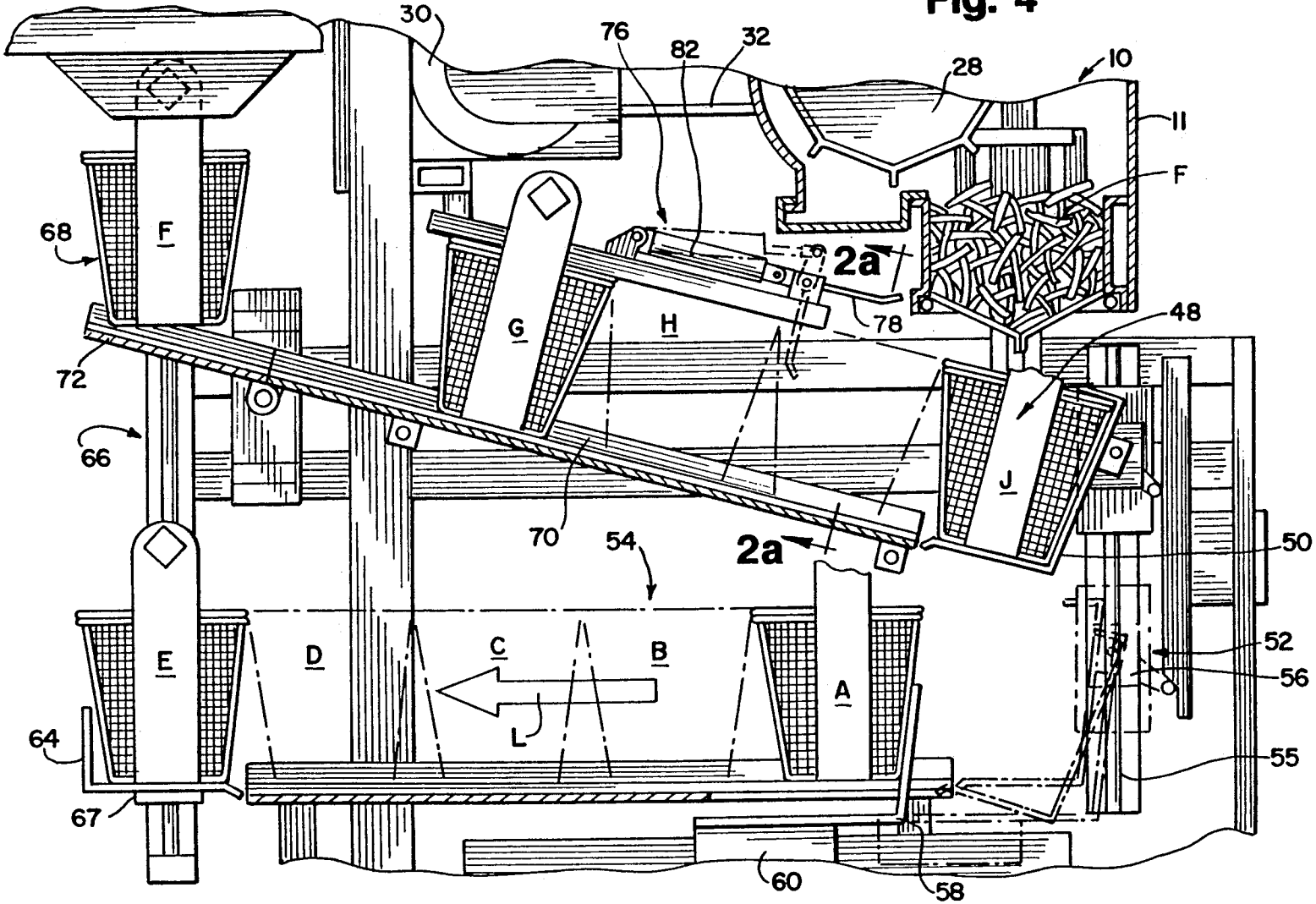
FIG. 4 is a fragmentary side elevation view of the conveyor system shown in FIG. 1 which illustrates basket filling and basket staging.
Figure 5:
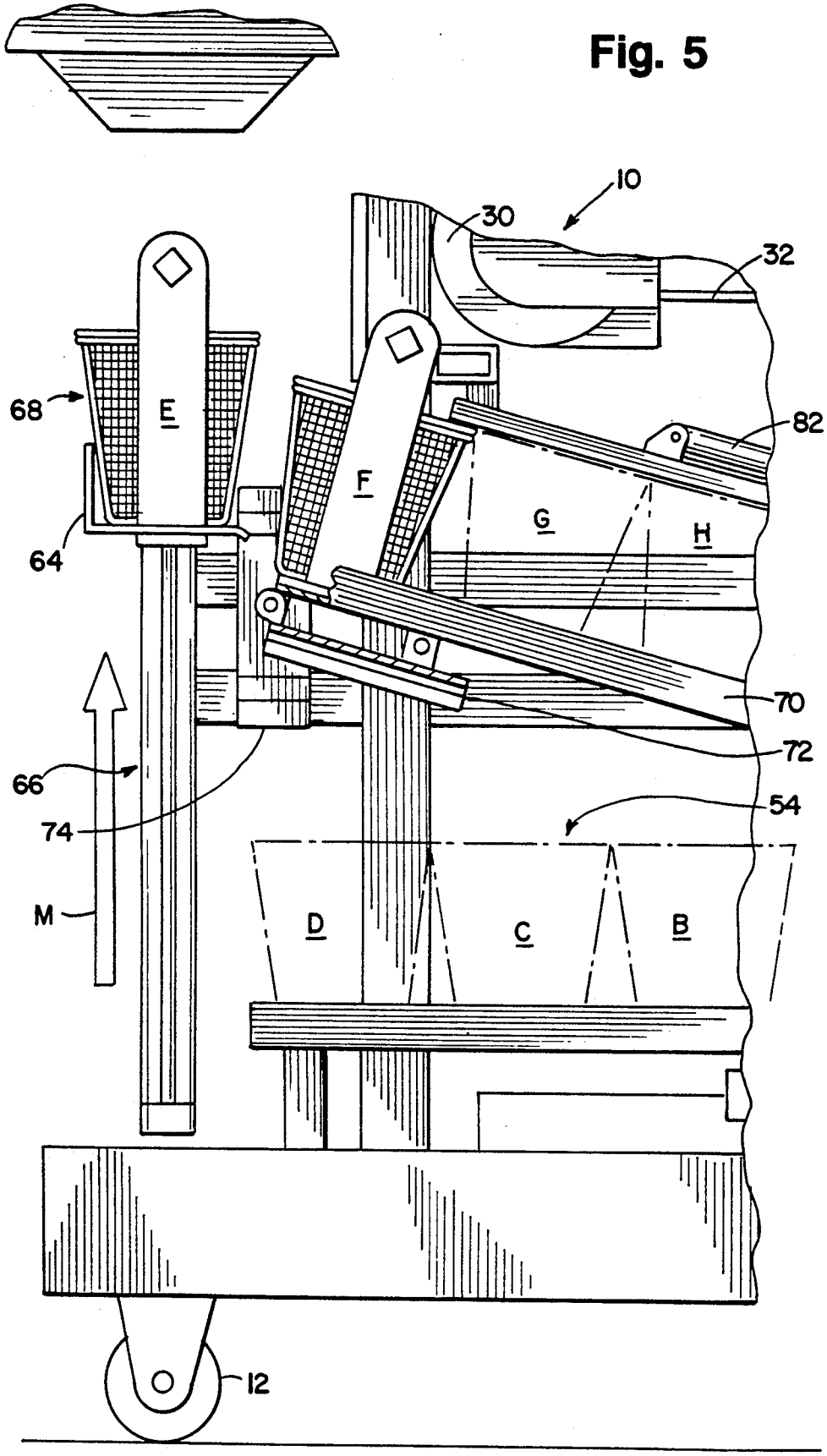
FIG. 5 is an enlarged fragmentary side elevation view of the part of the conveyor system of FIG. 4 which illustrates the raising of a filled basket from the basket staging area to the basket input-output station.

As can be seen by comparing FIG. 4 to FIG. 3, moving basket A causes baskets B, C, D and E to advance to the left in the direction of arrow L through staging area 54 one basket position. As a result, basket E now has been pushed onto basket frame lift 64. A first elevator sensor (not shown) verifies that basket frame 50 is empty, and frame 50 is lifted back up to filling station 48. Transfer arm 58 can be activated to advance the baskets in the staging area to the left two basket positions, if desired, such as when only four baskets (A, B, C and D, for example) are present in staging area 54.

Turning now to FIG. 4, it will be noted that an empty basket F has been placed on ramp door 72. When basket F is released, it will slide past door 72 and onto a fixed portion of ramp 70 as shown in FIG. 5.

Filled basket E is now ready to be lifted to basket input-output station 68 by second elevator 66. Referring again to FIG. 5, a second elevator sensor (not shown) verifies that basket E is correctly positioned on lift frame 64, pivotable door 72 is lowered to allow basket E to pass past ramp 70, and second elevator 66 lifts basket E in the direction of arrow M to input-output station 68. Basket E is then removed from elevator 66. A second elevator pick-up sensor indicates that elevator 66 is empty, and elevator 66 is returned to the staging area, and the filling and conveying cycles can be repeated.

FIG. 6 illustrates an optional air thaw system 90 for dispenser 10 consisting of an air plenum 92, a fan 94 and a filter 96. Fan 94 pulls air (arrows N') through filter 96 and into plenum 92 which directs the air downwardly (arrows M') into fry baskets for thawing french fries located in staging area 54.

Turning now to FIG. 7, an alternative embodiment of pivotable door 72 is shown in which an upwardly pivotable door 72*a* pivots above ramp 70 in the direction of arrow U when a basket E' is raised from below in the direction of arrow V. The pivotable door movement is initiated when basket handle 80 of basket E' pushes a door lever 81 upward as basket E' is raised. When basket E' is removed, door 72*a* falls down to its normal position.

FIGS. 8–10 illustrate an alternative drum and drive shaft useful in the dispenser invention. Referring first to FIG. 9, rotary drum 98 is a unitary component that can be produced by joining molded hollow drum portions 100 and 102 along line QQ. Preferably, drum portions 100 and 102 are molded from a powdered plastic material such as high density polyethylene, such as Microthene No. MA79515 from Quantum Chemical. Molded portions 100 and 102 can then be ultrasonically welded together or otherwise joined to produce unitary drum 98.

As best shown in FIG. 8, drum 98 includes 9 integral paddle members 104 protruding radially from the otherwise cylindrical drum surface 106. Paddle members 104 push food items to be dispensed from the storage bin. The absence of sharp edges on paddle members 104 minimizes damage to the dispensed food objects and prevents injury during cleaning. The unitary molded construction of drum 98 permits drum 98 to be produced relatively inexpensively (compared to an all metal construction) and its generally smooth continuous outer surface prevents the accumulation of small food particles in crevices or joints which would otherwise be present.

Drum 98 also includes a channel 110 for receiving a drive shaft 112 as illustrated in FIG. 10. Drive shaft 112 includes a keyed end 114 complementary in shape to channel 110 and a drive end 116 which can be coupled to any suitable structure for rotating shaft 112. The use of shaft 112 and channel 110 allows shaft 112 to be quickly and easily inserted into and removed from drum 98 for dispenser maintenance or cleaning.

FIGS. 11–14 illustrate a basket construction particularly useful in the dispenser invention. Referring simultaneously to FIGS. 11–14, a basket 118 includes a food product receptacle 120 having wire mesh sides 120*a–d* and a wire mesh bottom 120*e* welded or otherwise connected to a basket frame 122. A basket handle 124 having a grippable member 126 grippable by a human, tool or robot arm, as desired, is connected to one end of basket 118. A triangular basket support member 128 extends longitudinally from the bottom end of handle 124 to the opposite basket end. Support member 128 is attached to frame 122 and provides additional support for food receptacle 120.

Figure 13:
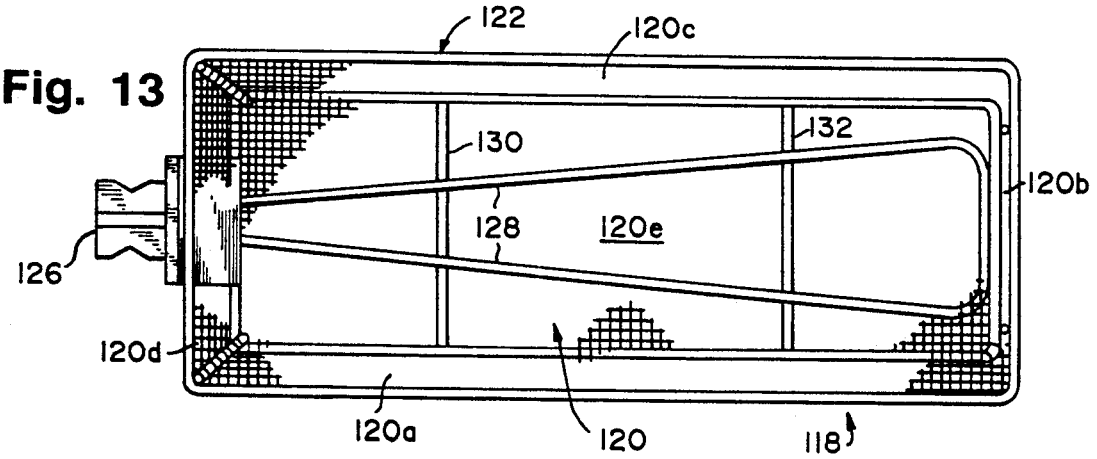
FIG. 13 is a top plan view of the basket of FIG. 11.
Figure 14:
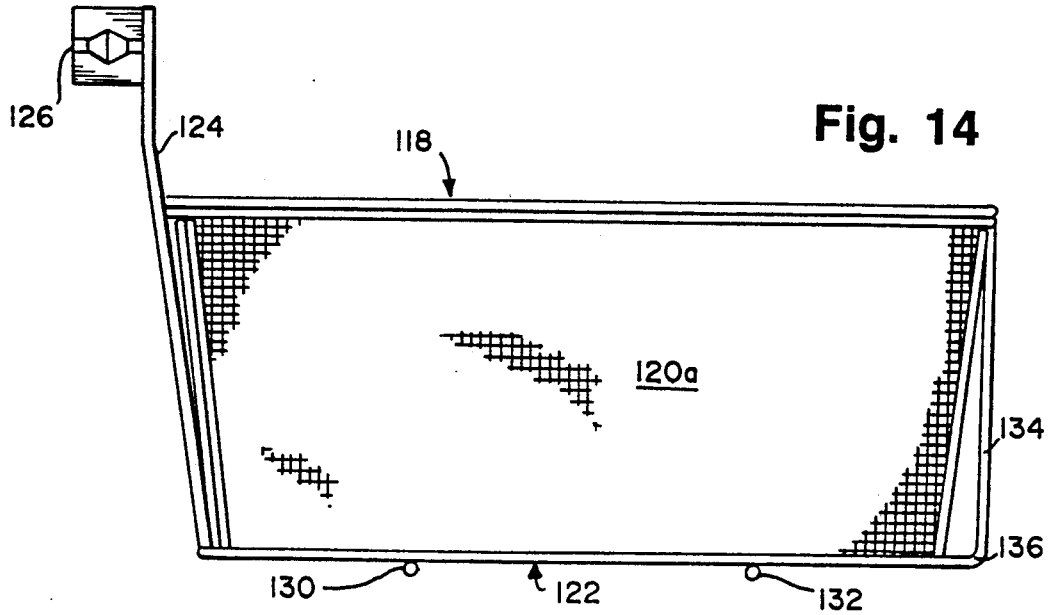
FIG. 14 is a side elevational view of the basket of FIG. 11.

Of particular importance are basket slides 130 and 132 which are attached to the bottom of frame 122 and which run transversely across the bottom of the frame as best seen in FIG. 13. Slides 130 and 132 which generally run in the direction of slidable basket travel on ramp 70 and allow basket 118 to slide more easily across an inclined ramp such as ramp 70.

Figure 11:
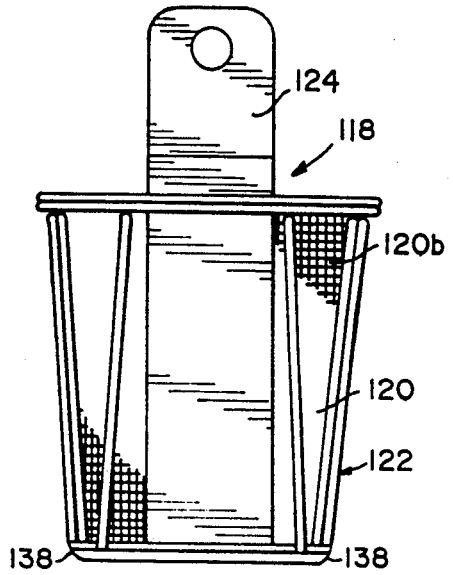
FIG. 11 is an end elevational view of a basket useful in the invention.
Figure 12:
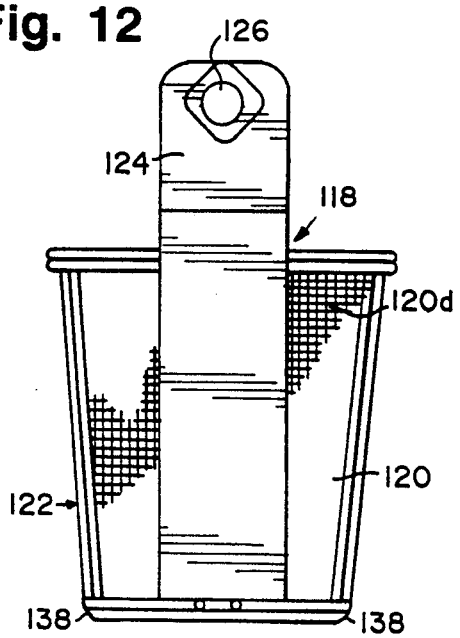
FIG. 12 is a end elevational view of the basket of FIG. 12 as viewed from the end opposite the end shown in FIG. 11.

To ensure proper operation of basket 118 in dispenser 10, several construction techniques are preferred. First, the flatness of basket slides 130 and 132 should be verified prior to welding slides 130 and 132 to basket frame 122. Additionally, a tight fit of all frame and handle components should be verified prior to welding the basket components together. Furthermore, all welds and sharp corners should be ground smooth after welding and corner edges of the basket should be beveled to prevent a corner edge from catching on a dispenser component. For example, downwardly extending member 134 of frame 122 (FIG. 14) should be beveled at its end 136, and the ends 138 of slides 130 and 132 should be beveled as shown in FIGS. 11 and 12. Finally, while basket 118 can be constructed from any suitable materials known in the art, it is preferred that basket 118 be nickel-plated after welding if basket 118 is to be used in a deep fryer or other similar cooking apparatus.

Figure 15:
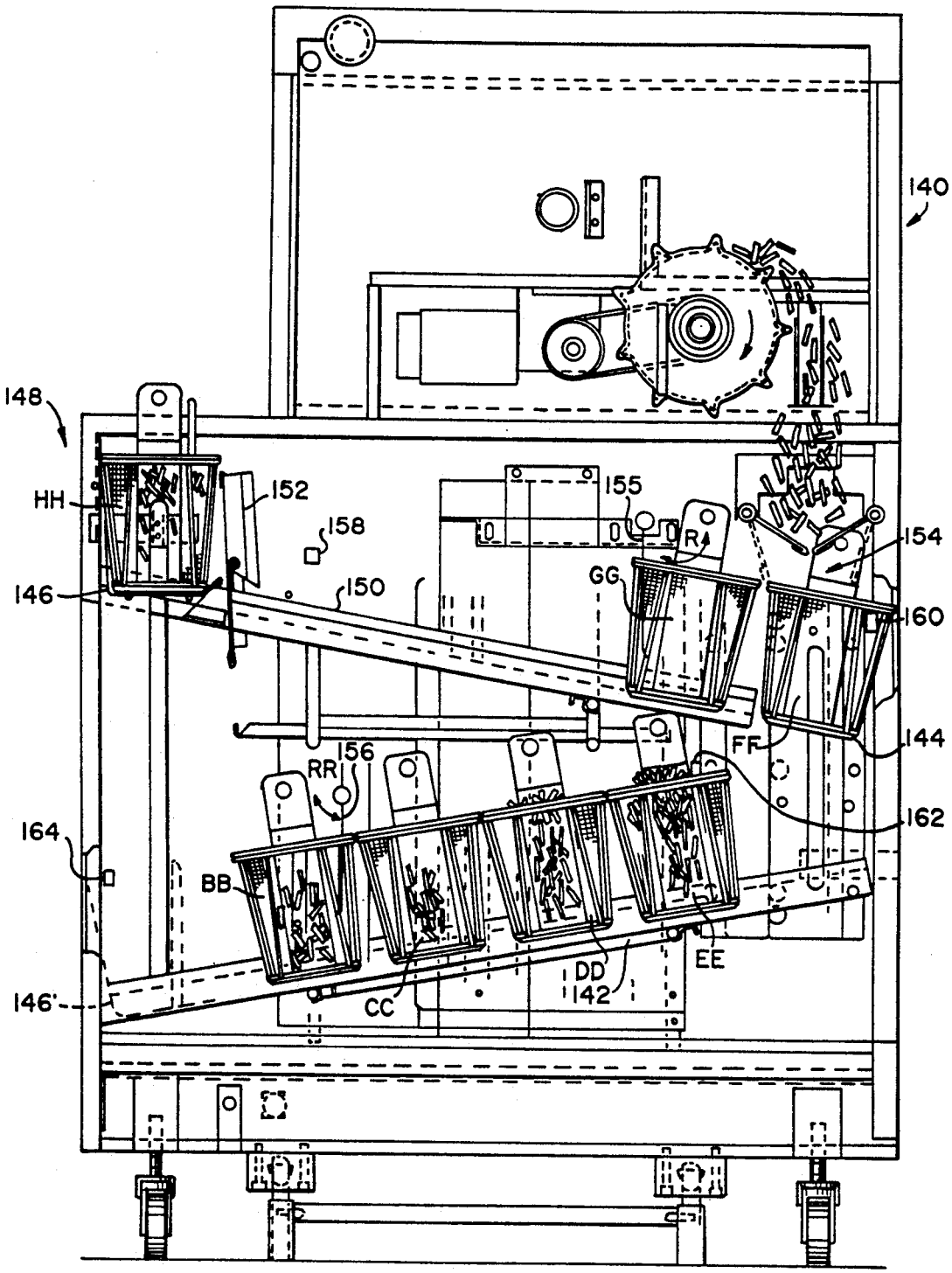
FIG. 15 is a side elevational view of an alternative embodiment of the dispenser which incorporates a pair of inclined ramps.

FIG. 15 illustrates an alternative embodiment of the invention. In this embodiment, a dispenser 140 employs a lower inclined ramp 142 to slidably move baskets by gravity from a first basket elevator 144 to a second basket elevator 146. Lower ramp 142 is preferred because it eliminates the need for transfer arm 58 and staging cylinder 60 used to push baskets across staging area 54 in dispenser 10.

The basket movement in dispenser 140 generally is similar to the basket movement described in connection with FIGS. 3–5. Empty baskets are deposited at the basket input-output station 148 located at upper end of upper inclined ramp 150 on the upwardly pivotable ramp door 152 when door 152 is in its lowered (dashed) position. Empty baskets (such as baskets HH and GG) then slidably move by gravity toward filling station 154 for filling (basket FF). The next basket to be filled (basket GG) is retained at an upper ramp position just above filling station 154 by a first pivotable basket stop arm 155 which is selectively actuated and movable in the direction of arrow R and can be raised to allow basket GG to slide into empty first elevator 144, thereby occupying the position indicated by basket FF. After filling basket FF, first elevator 144 deposits filled basket FF on lower ramp 142.

Filled baskets EE-BB slide down lower inclined ramp 142 toward second elevator 146 when movement is permitted by a second pivotable and selectively actuated basket stop arm 156 rotatable in the direction of arrow RR. Arm 156 prevents basket BB from moving into second elevator 146′ (shown in dashed lines in the lowered position) until elevator 146 has returned from basket input-output station 148. As described in conjunction with FIG. 7, pivotable ramp door 152 is movable to an "up" position to allow filled basket HH to be returned through door 152 to basket input-output station 148.

Dispenser 140 preferentially includes a plurality of fiber optic sensors for determining whether baskets are present or have passed by any of several locations within dispenser 140. Sensor 158 detects whether a basket has moved past the upper portion of upper ramp 150, sensor 160 detects whether a basket is present at filling station 154, sensor 162 detects whether a basket is present or has passed by the location occupied by basket EE in FIG. 15, and sensor 164 detects whether a basket is present on second elevator 146′. The signals from sensor 158, 160, 162 and 164 provide information which can be used to control the operation of various dispenser components such as stop arms 155 and 156. While the use of fiber optic sensors such as the Model E3XR-CER4 available from Omron Corporation of Schaumburg, Illinois is preferred, other types of sensors known in the art could also be employed.

While the invention has been described with respect to several specific embodiments, it is to be understood that the invention can accommodate numerous changes, modifications and rearrangements without departing from the invention as described by the appended claims.

What is claimed is:

1. A dispenser for dispensing bulk food items into a container comprising:

a storage bin for receiving and holding a quantity of bulk food items;

secondary bin receiving means for receiving at least a portion of desired size from the contents from said storage bin;

conveyor means for conveying food items from said storage bin to said secondary bin means;

a container filling station located beneath said secondary bin means at which station the contents from said secondary bin are received;

container conveyance means including a first inclined ramp for conveying a container to the container filling station and a second inclined ramp for conveying a container from the container filling station; and discharge means for dispensing items from said secondary bin means into an empty container at said filling station.

2. The dispenser of claim further comprising measuring means for measuring the quantity of food items present in said secondary bin receiving means and initiating the dispensing of food items from said secondary bin means.

3. The dispenser of claim 2 wherein said conveyance means includes means for sequentially accepting and positioning a plurality of empty containers and sequentially discharging filled containers.

4. The dispenser of claim 3 wherein said container conveyance means accepts empty containers at and returns filled containers to a single container input-output station.

5. The dispenser of claim 3 wherein said first inclined container ramp is a downwardly inclined ramp for allowing empty containers to slide towards said container filling station.

6. The dispenser of claim 5 wherein said container conveyance means further includes a first selectively movable container stop means for preventing any empty containers on said first inclined ramp from sliding downwardly when a filled container is moved from said container filling station.

7. The dispenser of claim 5 wherein said first inclined ramp includes a pivotable door for allowing at least a portion of said ramp to be moved to allow filled containers to pass through said ramp from below.

8. The dispenser of claim 5 further comprising a second selectively movable container stop means for preventing filled containers from sliding downwardly on said second ramp.

9. The dispenser of claim 1 wherein said conveyor means comprises a rotary drum in said storage bin for conveying the items from said storage bin to said portion receiving means.

10. The dispenser of claim 9 wherein said rotary drum includes paddle means for conveying items from said storage bin when said rotary drum rotates.

11. The dispenser of claim 10 wherein said drum is a unitary drum made of a molded plastic.

12. The dispenser of claim 11 wherein said dispenser includes a drive shaft having a keyed portion for rotating the drum and wherein said drum includes a channel complementary in shape to said keyed drive shaft portion for receiving said keyed portion.

13. The dispenser of claim 1 wherein said dispenser further comprises an air thaw system for directing air into said dispenser and toward filled baskets to thaw frozen food items contained in the filled baskets.

14. A food dispenser for dispensing a portion of bulk food items into a container comprising:

a storage bin for accepting and holding a quantity of food items and having a discharge opening along a bottom portion thereof;

a secondary bin for receiving a portion of desired size of food items from said storage bin;

a rotary drum for transferring food items from said storage bin to said secondary bin;

at least one secondary bin door for dispensing food items from said secondary bin;

a measuring device for measuring the contents of said secondary bin and initiating the opening of said at least one secondary bin door;

a container filling station located beneath said secondary bin means at which station the contents from said secondary bin are received; and a conveyor system for accepting empty containers, transporting empty containers to said filling station for filling from said secondary bin and for returning the filled containers from said filling station, said system including at least a first and a second inclined ramp for allowing containers to slide by gravity within said dispenser to and from said filling station.

15. The dispenser of claim 14 wherein said conveyor system includes a selectively actuated container stop means for preventing a first container from sliding down a ramp by gravity.

16. The dispenser of claim 15 further comprising a second selectively actuated movable container stop means for preventing filled containers from sliding downwardly on said second inclined ramp.

17. The dispenser of claim 14 wherein said conveyor system includes:

a first container elevator having a container frame for supporting a container at said filling station and for lowering the filled container to said second inclined ramp after the container has been filled; and a second container elevator for lifting a filled container from said second inclined ramp.

18. The dispenser of claim 17 wherein said first container elevator includes a pivot mechanism for pivoting said basket frame between a first inclined orientation when said frame is at said filling station and a second inclined orientation when said frame is adjacent said second inclined ramp.

19. The dispenser of claim 17 wherein said first inclined ramp includes a pivotable door for permitting said second elevator to raise a filled container from said second inclined ramp past said first inclined ramp.

20. The dispenser of claim 17 wherein said conveyor system accepts empty containers from and returns filled containers to a common container input-output station.

21. The dispenser of claim 14 wherein said conveyor system accepts empty containers from and returns filled containers to a common container input-output station.

22. The dispenser of claim 14 wherein said measuring device is a load cell.

23. The dispenser of claim 22 wherein said secondary bin includes a pair of downwardly opening doors responsive to said load cell for dispensing a desired portion of food items into an empty container.

24. The dispenser of claim 14 wherein said rotary drum includes a plurality of paddles extending outwardly from said drum for conveying food items from said storage bin.

25. The dispenser of claim 24 wherein said drum is a unitary molded plastic drum.

26. The dispenser of claim 14 which further comprises an air thaw system for directing air toward said dispenser staging area for thawing frozen food items held therein.

27. A food dispenser for automatically dispensing portions of bulk food items into baskets comprising:

a storage bin for accepting and holding a quantity of food items;

a secondary bin for receiving a portion of items from said reservoir;

a rotary drum for transferring the food items from said storage bin to said secondary bin;

at least one bin door for dispensing food items into said secondary bin;

a measuring device for measuring the contents of said secondary bin and for initiating the opening of said at least one bin door;

a basket filling station located beneath said secondary bin means at which station the contents from said secondary bin are received; and a conveyor system for accepting empty baskets, transporting empty baskets to the basket filling station and returning the filled baskets from said dispenser, said conveyor system including a first inclined ramp for allowing empty baskets to slide towards said filling station, said ramp having a pivotable inclined ramp portion which can be raised to permit filled baskets to be raised past said ramp, a second inclined ramp for allowing filled baskets to be conveyed away from said filling station, a first selectively actuable basket stop mechanism for preventing any empty baskets from sliding down said ramp into said filling station, a second selectively actuable basket stop mechanism for preventing filled baskets from sliding down said second ramp, a first basket elevator for supporting a basket at said filling station and for lowering the filled basket to said second inclined ramp after the basket has been filled, and a second basket elevator for lifting a filled basket from said second inclined ramp.

28. The dispenser of claim 27 wherein said conveyor system accepts empty baskets from and returns filled baskets to a common container input-output station.

29. The dispenser of claim 27 wherein said measuring device is a load cell.

30. The dispenser of claim 29 wherein said secondary bin includes a pair of downwardly opening doors responsive to a signal from said load cell to dispense a desired portion of food items into a basket.

31. The dispenser of claim 27 wherein said rotary drum includes a plurality of paddles extending outwardly from said drum for conveying food items from said storage bin.

32. The dispenser of claim 31 wherein said rotary drum is a unitary drum made from a plurality of molded plastic portions.

33. A dispenser for dispensing bulk items into a container comprising:

a storage bin for accepting and holding a quantity of bulk items and having a discharge opening along a bottom portion thereof;

a container filling station located below said bin for receiving bulk items from the bin.

a storage bin conveying device for conveying items from said storage bin to a container at said container filling station; and a conveyance system for transporting at least one container to or from said bin emptying station, said conveyance system including an inclined ramp for allowing an empty container to slide by gravity from a first position within the dispenser towards said container filling station.

34. The dispenser of claim 33 wherein said conveyance system includes a container stop mechanism for preventing a first container from sliding down said ramp when a second container generally adjacent to and lower on the ramp than said first container is moved away from said first container down the ramp.

35. The dispenser of claim 33 wherein said ramp includes a pivotable door for allowing said conveyance system to raise a filled container past said door when said door is moved from an original inclined ramp position.

36. The dispenser of claim 33 wherein said storage bin conveying device comprises a rotary drum for conveying food items from said storage bin.

37. The dispenser of claim 36 wherein said rotary drum includes at least one paddle for conveying food items from said storage bin.

38. The dispenser of claim 37 wherein said drum is a unitary drum constructed from molded plastic members.

39. The dispenser of claim 37 wherein said drum is a unitary drum constructed from two molded plastic members ultrasonically welded together.

40. The dispenser of claim 36 wherein said dispenser employs a drive shaft having a keyed portion for rotating said drum and wherein said drum includes an axial channel complementary to said keyed portion for receiving said keyed portion thereby permitting said drum to be rotated by said drive shaft.

* * * * *